US006932400B2

(12) United States Patent
Gipson

(10) Patent No.: US 6,932,400 B2
(45) Date of Patent: Aug. 23, 2005

(54) DESKTOP BIBLE CARRYING CASE

(76) Inventor: Gwendolyn Gipson, 6827 Indian Falls, Missouri City, TX (US) 77489

( * ) Notice: Subject to any disclaimer, the term of this patent is extended or adjusted under 35 U.S.C. 154(b) by 45 days.

(21) Appl. No.: 10/725,122

(22) Filed: Dec. 2, 2003

(65) Prior Publication Data

US 2005/0116484 A1 Jun. 2, 2005

(51) Int. Cl.[7] ..... A45F 5/12; A45F 3/00

(52) U.S. Cl. ..... 294/138; 281/45; 281/48; 281/49; 281/51; 248/481

(58) Field of Search ..... 294/138, 141; 281/15.1, 35, 45, 48, 51; 248/460, 461, 446; 206/45.23, 320, 424; 190/114

(56) References Cited

U.S. PATENT DOCUMENTS 2,270,611 A * 1/1942 Spaulding ..... 294/142
2,271,348 A * 1/1942 Sampson ..... 294/143
2,318,192 A * 5/1943 Boelema, Jr. ..... 281/31
2,588,152 A * 3/1952 Newman ..... 221/37
2,716,985 A * 9/1955 Wolf ..... 402/4
3,813,075 A * 5/1974 Capper ..... 248/461
4,555,128 A * 11/1985 White et al. ..... 281/45
4,711,469 A * 12/1987 Bogar ..... 281/27.2
4,978,096 A * 12/1990 Struckmann ..... 248/451
5,400,303 A * 3/1995 Tu et al. ..... 368/157
5,680,914 A * 10/1997 Reiser ..... 190/11
6,161,979 A * 12/2000 Yamamoto et al. ..... 402/73

* cited by examiner

*Primary Examiner*—Kathy Matecki
*Assistant Examiner*—Esther O. Okezie
(74) *Attorney, Agent, or Firm*—Kenneth D. Baugh

(57) ABSTRACT

A desktop bible carrying case 10 is provided with an enclosure 12 having a cavity 24 formed therein. A rectangular shaped support ridge 26 is coupled in the cavity 24 to inside portions of the enclosure 12. A flexible lid 28 is provided which is pivotably coupled to a back portion of the enclosure 12. Additionally, a planar shaped desktop member 50 is pivotably coupled to the enclosure adjacent to and between the lid 28 and the support ridge 26. An elevating member 52 is pivotably coupled to an outermost end of the desktop member 50. As a result a desktop bible carrying case 10 is provided to carry a bible 60 and a pad 62 in the open area 24 until they are removed therefrom and positioned on the desktop member 50 for use.

19 Claims, 5 Drawing Sheets

DESKTOP BIBLE CARRYING CASE

TECHNICAL FIELD

This invention relates to bible carrying cases and more particularly to a desktop bible carrying case. For some time bible carrying cases have served as a storage container and apparatus for carrying our bible from one destination to another. The popularity and practically of bible carrying cases is well known. As a result you now have bible carrying cases of all shapes and sizes to accommodate the many various bibles we use today. Although there are a variety of bible carrying cases in existence, there is still a problem which arises after we have arrived at our destination with our bible that is presently not addressed by the existing carrying cases. Most often than not our destination is a church pew so there is the problem of not having a sturdy structure on which to set the bible and a note pad once the bible is removed from the case so that we may study and take notes as desired. Trying to study and take notes becomes an almost impossible task when there is no structure on which to accommodate the bible and pad. Many persons attempt to balance the bible on one leg while trying to balance a writing pad on the other leg. Other persons try to bridge both legs together, hold an open bible thereon and then lay the writing pad on top of the bible to take notes. The writing pad is then in most cases switched back and forth from top to under the bible depending on whether you are writing or looking up a scripture. This process becomes cumbersome and very tedious. There is a need for a bible carrying case that can be used to solve this problem.

Accordingly, a bible carrying case is desirable that is durable enough to make it practical for a user to use it as a carrying case while also being convertible into a lap desktop to accommodate a bible and writing pad simultaneously when a desk or other structure is unavailable.

BACKGROUND OF THE ART

Attempts have been made to provide portable lap assemblies or briefcases. One such apparatus is disclosed in U.S. Pat. No. 5,680,914. The apparatus of this invention is a portable lap office assembly having an internal desktop writing surface. The apparatus includes a case having a lower portion and upper portion being hinged to the lower portion to undergo pivotal movement relative thereto between open and closed positions. Each of the upper and lower portions has an exterior and interior surface and a desktop inserted in a cavity in the lower portion of the case. Another arrangement is disclosed in U.S. Pat. No. 4,700,634. This invention discloses a lap oriented portable desk unit. The unit of this invention is a unique easily employable, portable lap oriented desk unit. The unit includes support cushion means affixed to a housing assembly. The unit also includes a work supporting surface and a fully contained illumination means. Additionally the desk unit also includes an enclosed storage means for storing which ever equipment is needed to complete the task.

These arrangements are suitable for the purposes for which they are designed. However they are not designed to serve as a carrying case and storage compartment for a bible and are not readily useable as a desktop in the environment in which the bible is used. There is still a need for a bible carrying case that is readily convertible into a lap desktop to hold a bible and writing pad simultaneously when a desk or other such structure is unavailable.

DISCLOSURE OF THE INVENTION

A desktop bible carrying case in accordance with the principles of this invention is provided with an upstanding front wall and an upstanding back wall aligned with and spaced from the front wall. The back wall has a flexibly extending skirt member coupled to extend from upper portions thereof. The case is also provided with a first side wall which is coupled to extend between one end of the front and back walls and a second side wall which is coupled to extend between another end of the front and back walls. A bottom wall is aligned in coupling engagement with bottom portions of the front and back and first and second side walls. Additionally a flexible extending top wall is provided having end portions thereof pivotably coupled to the back wall. The front, back, side, bottom and top walls are coupled together to form an enclosure having a cavity formed therein. A support ridge is formed on inside portions of the front, back and side walls in the enclosure cavity.

The carrying case is further provided with a planar shaped desk-like member pivotably coupled to the back wall adjacent to and between the top wall and the support ridge. The planar shaped desk-like member is provided with an elevating member which is pivotably spring biasly coupled to an outermost end thereof adjacent to the back wall of the enclosure. As a result the bible carrying case is readily convertible from a carrying case to support a bible and pad thereon which is stored therein.

BRIEF DESCRIPTION OF THE INVENTION

The details of the invention will be described in connection with the accompanying drawing which:

BEST MODE FOR CARRYING OUT THE INVENTION

Figure 5:
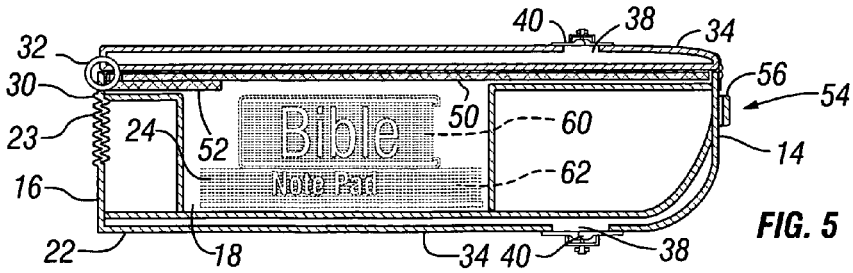
FIG. 5 is a cut-away view of the desktop bible carrying case in accordance with the principles of the invention.

Referring to FIGS. 1, 2, 3, 4 and 5, a desktop bible carrying case, generally designated, by the numeral, 10, is illustrated. The bible carrying case 10 includes an enclosure, generally designated, by the numeral, 12 (FIG. 5). The enclosure 12 is provided with front and back walls, 14 and 16, side walls, 18 and 20 and a bottom wall, 22. The back wall 16 and side walls 18 and 20 each include a flexibly extending skirt-like member 23 formed in upper portions thereof. The walls 14, 16, 18, 20 and 22 are coupled together so that the enclosure 12 is formed having an open area or cavity 24 (FIG. 5) formed therebetween. The walls 14, 16, 18, 20 and 22 are formed of a sturdy material normally used for such carrying cases.

The enclosure 12 is also provided with a support ridge 26 which is formed in the open area 24 on the walls 14, 16, 18, 20 and 22.

The enclosure 12 is also provided with a flexible lid or top, generally designated by the numeral, 28. The lid is pivitably coupled to an upper end portion 30 of the back wall 16 of the enclosure 12 by a spiral coupling member 32 aligned to pivotably engage inside and outside portions of the lid and back wall in a well known manner. The bottom wall 22 and the lid 28 are each formed with outer and interior spaced wall members 34 and 36 having a cavity 38 formed therebetween (FIG. 5). The cavity 38 is provided for storage of miscellaneous items such as for example pens, pencils and maybe even written material. The bottom wall 22 and lid 26 are also each provided with an elongated access opening 40 which allows access to the cavity 38. The access openings 40 can be opened and closed by a sealing member 42. The sealing member 42 may be for example, a standard zipper. An elongated pen holder 43 is coupled adjacent each side wall 18 and 20 on the support ridge 26.

A coupling member, generally designated by the numeral, 44 is provided having a first elongated coupling member 46 formed along lower portions of the periphery of the lid 26 and a second elongated coupling member 48 formed along upper portions of the periphery of the front and side walls 14, 18 and 20 respectively. The first and second coupling members 46 and 48 lockingly engage each other to secure the lid 26 in place on the other portions of the enclosure 12 and may be for example a zipper also.

As shown in FIGS. 5, 6, 7 and 8 the desktop bible carrying case 10 is also provided with a lap desktop member 50. The lap desktop member 50 is pivotably coupled at an end adjacent the back wall 16 and between the lid 28 and the support ridge 26 by the spiral coupling member 32. The lap desktop member 50 is provided with an elevating member 52 formed on an end thereof adjacent the back wall 16. The elevating member 52 is spring biased outwardly and pivotably coupled to an underside 51 of the lap desktop member 50 adjacent the back wall 16. The elevating member 52 allows the lap desktop member 50 to be supported in a diagonal upright position on the support ridge 26 when desired.

Figure 1:
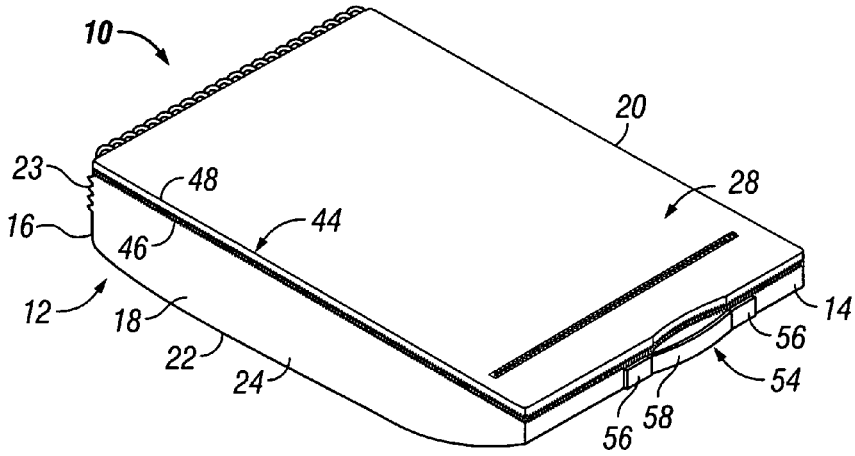
FIG. 1 is a perspective view illustrating a desktop bible carrying case in accordance with the principles of the invention.
Figure 2:
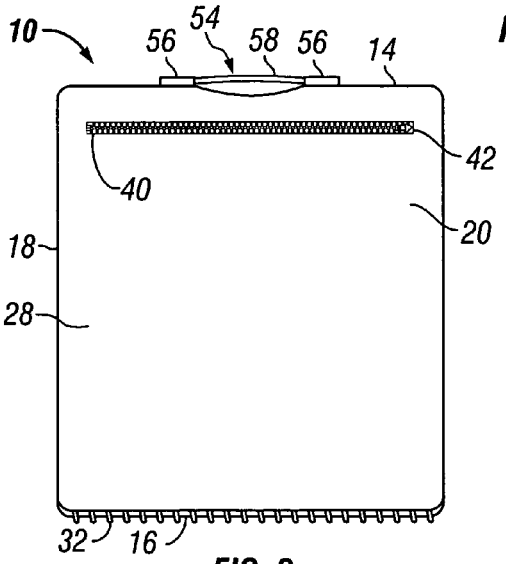
FIG. 2 is a front view of the desktop bible carrying case in accordance with the principles of the invention.
Figure 3:
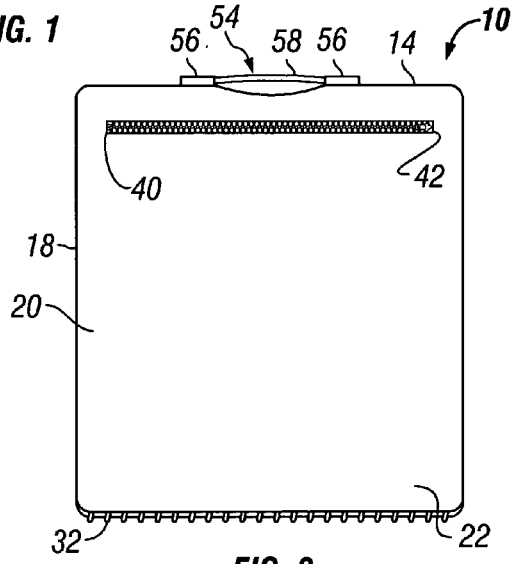
FIG. 3 is a back view of the desktop bible carrying case in accordance with the principles of the invention.
Figure 4:
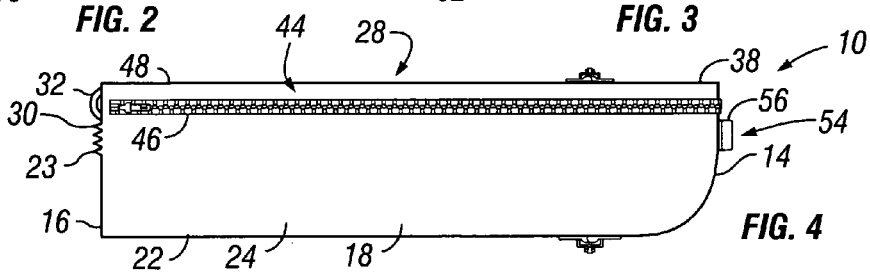
FIG. 4 is a side view of the desktop bible carrying case in accordance with the principles of the invention.
Figure 6:
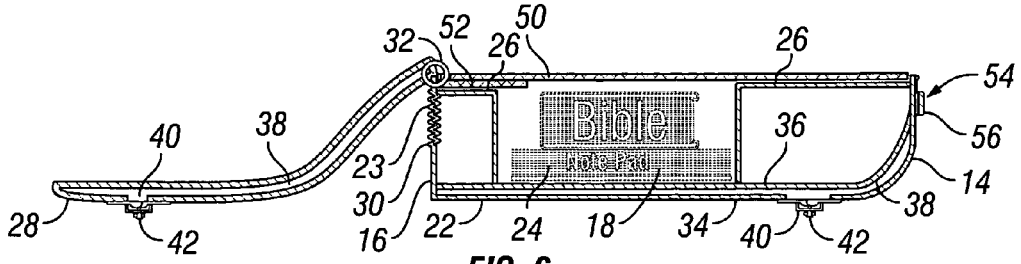
FIG. 6 is a cut-away view of a desktop bible carrying case with the top open in accordance with the principles of the invention.
Figure 7:
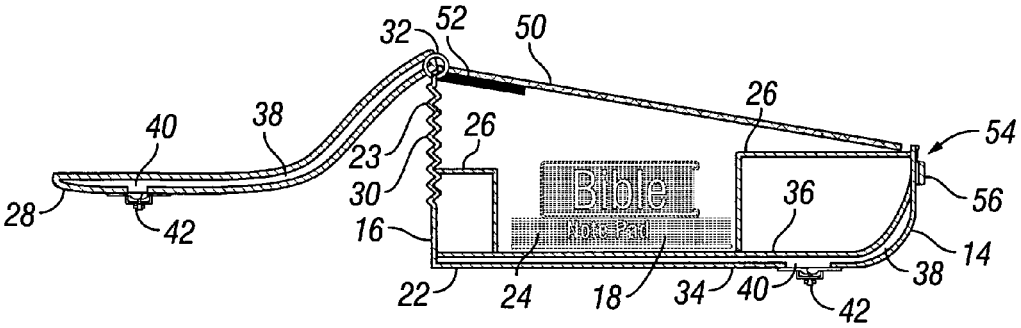
FIG. 7 is a cut-away view of the desk top bible carrying case with the top open and desktop pivoted to a diagonal position in accordance with the principles of the invention.
Figure 8:
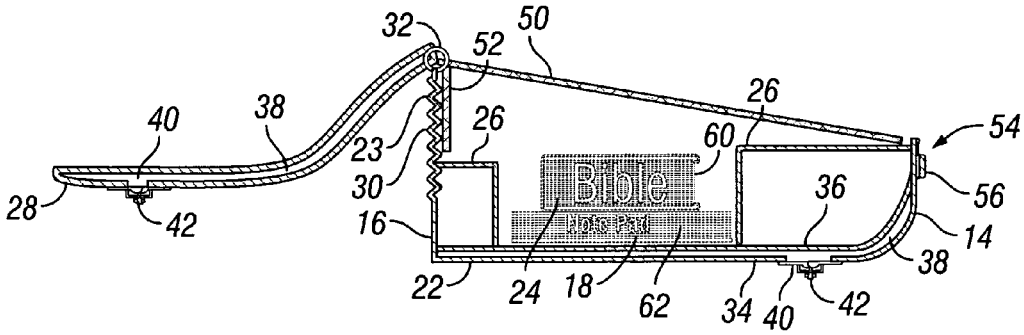
FIG. 8 is a cut-away view of the desktop bible carrying case with the desktop pivoted to a diagonal position and the elevating member unfolded in accordance with the principles of the invention.
Figure 9:
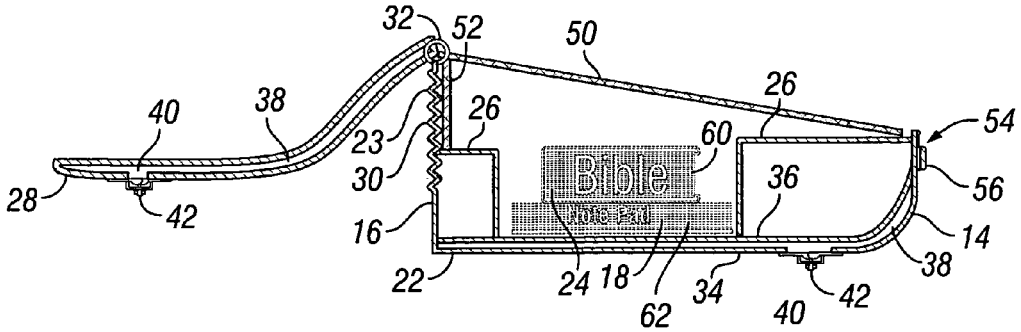
FIG. 9 is a cut-away view of a desktop bible carrying case with the desktop supported in a diagonal elevated position in the carrying case in accordance with the principles of the invention.

The desktop carrying case 10 is also provided with a handle, generally designated by the numeral, 54, which is coupled to the front wall 14 of the enclosure (FIG. 1). The handle 54 is provided with support members 56 coupled to the front wall 14 of the enclosure 12 and a grip member 58 slidably coupled in the support members in a well known manner. This allows the handle 54 to be retractable. The carrying case 10 may also be provided with a detachable shoulder strap (not shown). The desktop bible carrying case 10 is provided to carry a bible 60 and pad 62 (shown in dotted in FIG. 5) in the open area 24. When it is desired to use the bible 60 and pad 62 the lap desktop member 50 is lifted so that the bible 60 and pad 62 can be removed from the open area 24. The lap desktop member 50 can then be positioned as desired by the user such as illustrated in FIG. 6 or 9 so that the bible 60 and pad 62 can be supported thereon and used with relative comfort.

A second embodiment of a desktop bible carrying case, generally designated by the numeral, 64 is illustrated in FIGS. 10 through 17.

Figure 13:
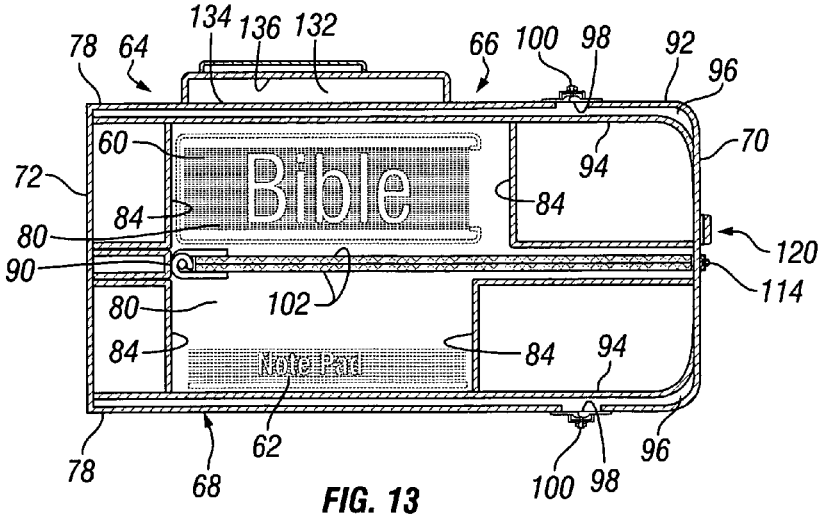
FIG. 13 is a cut-away view of a second embodiment of a desktop bible carrying case in accordance with the principles of the invention.

The desktop bible carrying case 64 includes a pair of enclosures, generally designated, by the numerals, 66 and 68 respectively (FIG. 13). Each enclosure 66 and 68 is provided with front and back walls, 70 and 72, side walls, 74 and 76 and a bottom wall, 78. The walls 70, 72, 74, 76 and 78 are coupled together so that the enclosures 66 and 68 each have an open area 80 formed therebetween. The side walls 76 and back walls 70 and 72 are provided with a flexibly extending skirt-like member 81 coupled to uppermost portions thereof. Each enclosure 66 and 68 is also provided with a rectangular shaped support ridge 84 which is formed in the open area 80 on the walls 70, 72, 74, 76 and 78.

The enclosures 66 and 68 are coupled to each other at upper portions 86 of the back walls 72 of the enclosures by a spiral coupling member 90 aligned to engage outside portions of the back walls.

Each bottom wall 78 of the enclosures 66 and 68 are formed with exterior and interior spaced wall members 92 and 94 having a cavity 96 formed therebetween (FIG. 13). The cavities 96 are provided for additional storage space for the user. The bottom walls 78 are also each provided with an elongated access opening 98 which allows access to the cavity 96.

The access opening 98 can be opened and closed by a sealing member 100 which may be for example, a standard zipper.

Each enclosure 66 and 68 of the bible carrying case 64 is also provided with a lap desktop member 102. The lap desktop members 102 are pivotably coupled to each other by a plurality of hinges 103 (shown in dotted) which are coupled to the underside of the lap desktop members 102. The lap desktop members 102 are coupled at ends adjacent the side wall 76 to the flexibly extending skirt-like member 81. An elevating member 104 is spring-biased outwardly and pivotably coupled to an underside of one end of the lap desktop members 102 at an uppermost end thereof. The elevating members 104 allow the lap desktop members 102 to be supported in a diagonal upright position on the adjacent support ridge 84 when desired. An elongated shaped pen holder, generally designated by the numeral, 108 having an opening 110 formed therein adjacent each top wall 70 on the support ridge 84. The pen holder 108 is provided to support a pen or pencil therein to be used as desired.

A coupling member, generally designated by the numeral, 114 is provided having a first elongated coupling member 116 formed along the periphery of the walls 70, 74 and 76 of the enclosure 66 and a second elongated coupling member 118 formed along the periphery of the walls 70, 74 and 76 of the enclosure 68. The first and second elongated coupling members 116 and 118 lockingly engage each other to couple the enclosures 66 and 68 together for carrying, and may be for example a standard zipper also.

Figure 10:
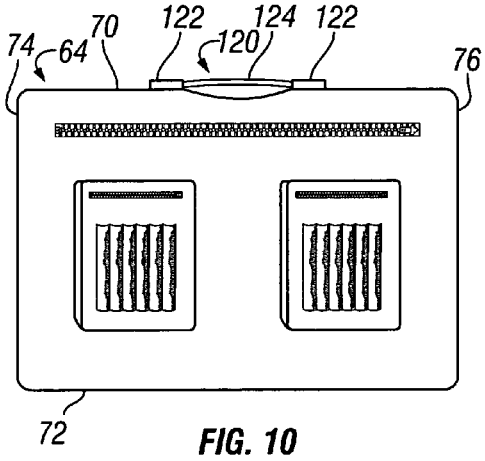
FIG. 10 is a front view of a second embodiment of a desktop bible carrying case in accordance with the principles of the invention.
Figure 11:
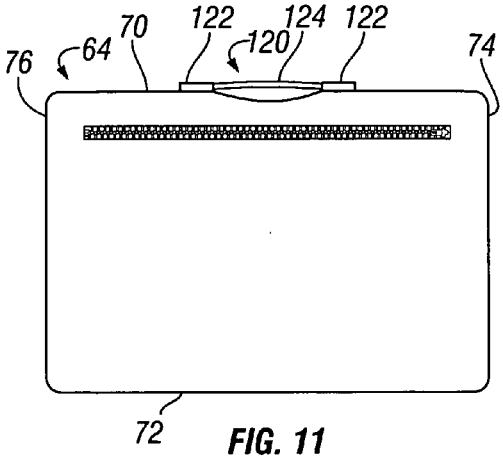
FIG. 11 is a back view of a second embodiment of a desktop bible carrying case in accordance with the principles of the invention.
Figure 12:
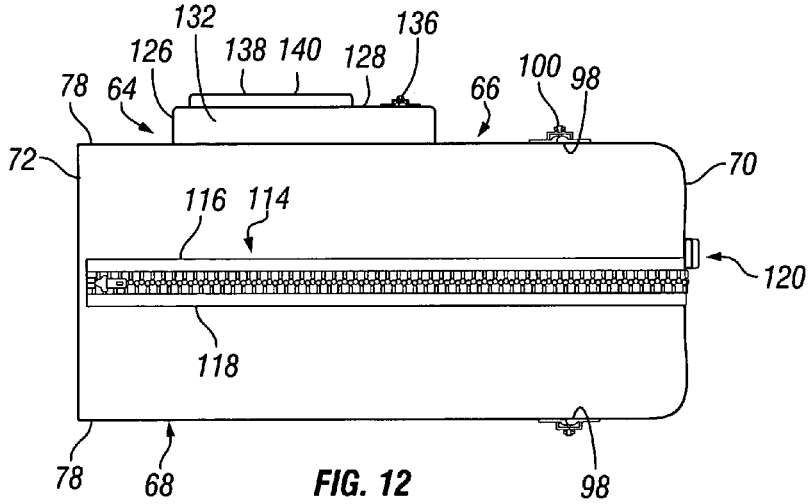
FIG. 12 is a side view of a second embodiment of a desktop bible carrying case in accordance with the principles of the invention.

The desktop bible carrying case 64 is also provided with a handle, generally designated by the numeral, 120, which is coupled to the front wall 70 of the enclosure 66 (FIG. 10). The handle 120 is provided with support members 122 coupled to the front wall 70 of the enclosure 66 and a grip member 124 slidably coupled to the support members. This allows the handle 120 to be retractable. The carrying case 64 may also be provided with a detachable shoulder strap (not shown).

The bible carrying case also includes a pair of storage pockets, generally designated by the numerals, 126 coupled to the bottom wall 78 of the enclosure 66. The pockets 126 are formed with spaced wall members 128 and 130 having a cavity 132 formed therebetween. The pockets 126 are also provided with an elongated access opening 134 which allows access to the cavity 132. The access opening 134 is opened and closed by a sealing member 136 such as for example a zipper.

The pockets 126 are also provided with a plurality of elongated shaped pen holders 138 having openings 140 formed therein. The pen holders 138 are also provided to carry pencils or pens as desired.

Figure 14:
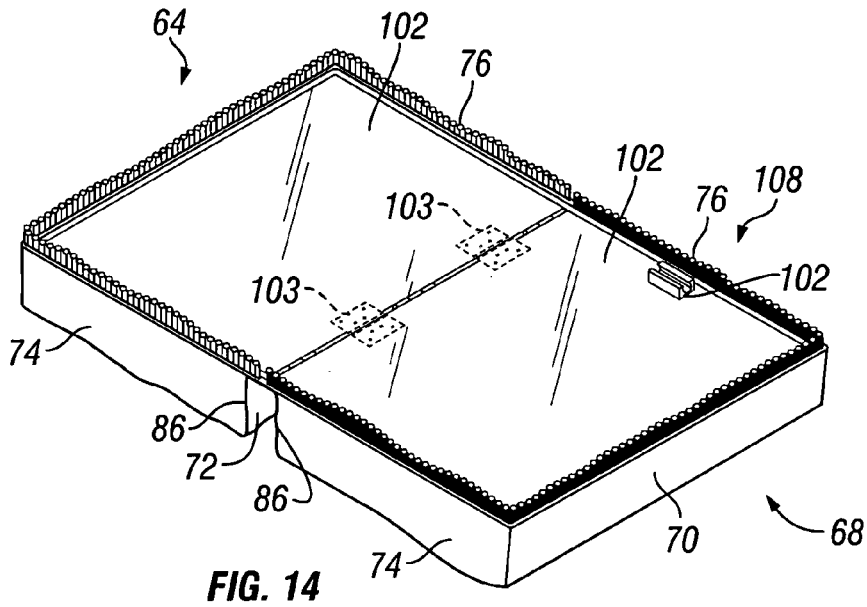
FIG. 14 is a first perspective view of a second embodiment of a desktop bible carrying case in an open position in accordance with the principles of the invention.
Figure 15:
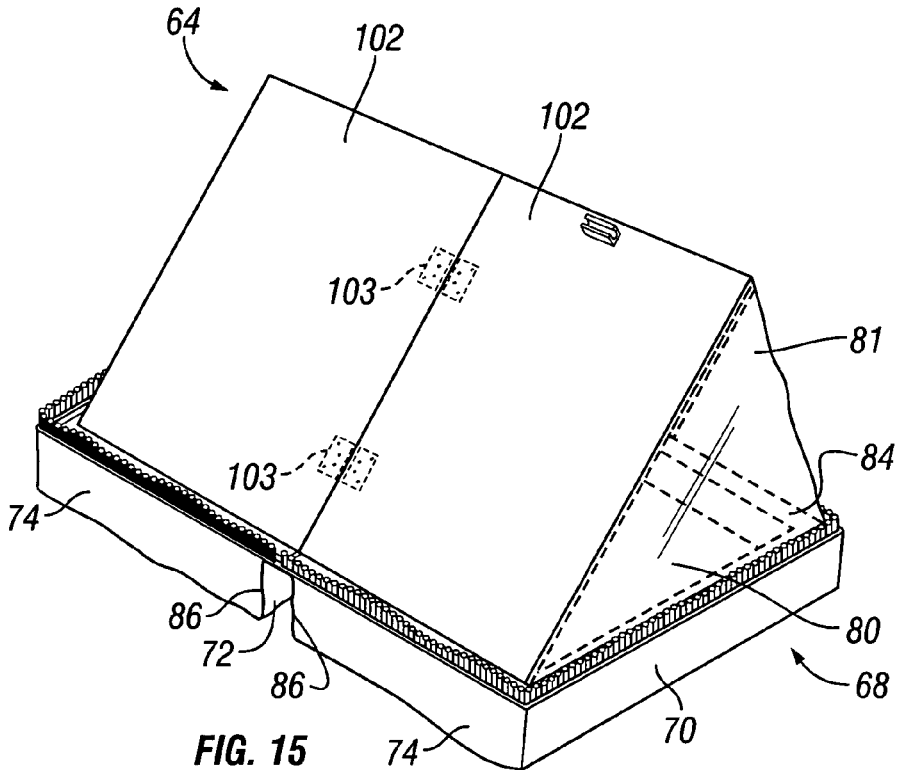
FIG. 15 is a second perspective view of a second embodiment of a desktop bible carrying case in an open position with each desktop supported in a diagonal position in accordance with the principles of the invention.
Figure 16:
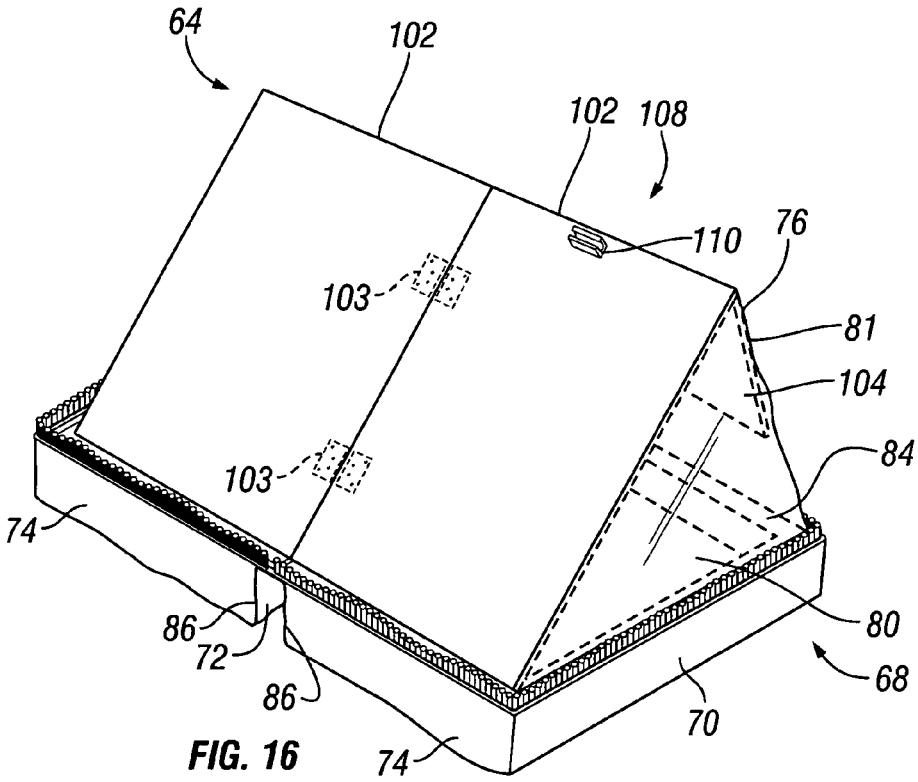
FIG. 16 is a third perspective view of a second embodiment of a desktop bible carrying case in an open position with each desktop pivoted to a diagonal position and the elevating member unfolded in accordance with the principles of the invention.
Figure 17:
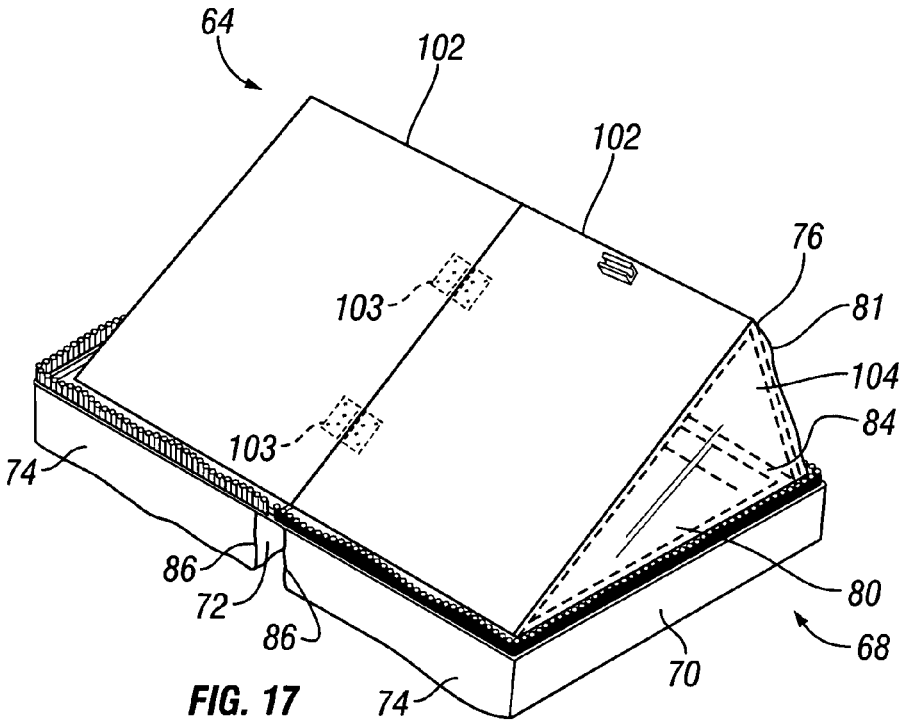
FIG. 17 is a fourth perspective view of a second embodiment of a desktop bible carrying case in an open position with each desktop pivoted to a diagonal support position in the carrying case in accordance with the principles of the invention.

The bible carrying case 64 is also provided to carry a bible 60 (FIG. 13) in one of the open areas 80 and a pad 62 (FIG. 13) in the other open area 80. The bible 60 and pad 62 are stored and held securely under the lap desktop members 102. When it is desired to use the bible 60 and pad 62 the lap desktop members 102 are lifted so that the bible 60 and pad 62 can be removed from the open areas 80. The lap desktop members 102 can then be positioned as desired such as shown in FIGS. 14 and 17 to support the bible 60 and pad 62 thereon as is desired by the user.

It should be understood that various changes and modifications can be made without departing from the spirit and scope of the invention as defined in the claims.

What is claimed is:

1. A desktop bible carrying case including:

an upstanding front wall;

an upstanding back wall aligned with and spaced from the front wall;

a first side wall coupled to extend between one end of the front and back walls;

a second side wall coupled to extend between another end of the front and back walls;

a flexibly extending skirt-like member coupled to extend from upper portions of the back wall and first and second side walls;

a bottom wall aligned in coupling engagement with bottom portions of the front and back and first and second side walls, so that a cavity is formed between the walls;

a support ridge coupled in the cavity to inside portions of the front, back and side walls;

a top flexible extending wall having end portions thereof pivotably coupled to the back wall;

a planar shaped desktop member pivotably coupled to the back wall adjacent to and between the top wall and the support ridge; and an elevating member pivotably coupled to an outermost end of the desktop member adjacent to the back wall.

2. A desktop bible carrying case as defined in claim 1 further including a first coupling means for pivotably coupling the top wall to the upper end portions of the back wall and for pivotably coupling one end of the desktop member adjacent the back wall between the top wall and support ridge.

3. A desktop bible carrying case as defined in claim 2 wherein the first coupling means includes an elongated spiral coupling member aligned to engage inside and outside portions of the top and back wall and end portions of the desktop member, so that the top is pivotable from a closed position to an open position and so that the desktop member is pivotable from a parallel position to a diagonal position.

4. A desktop bible carrying case as defined in claim 3 wherein the top wall includes:

an interior wall member;

an exterior wall member having an opening formed therein aligned adjacent to and spaced from the interior wall members so that a cavity is formed therebetween and so that access to the cavity can be gained through the opening in the exterior wall.

5. A desktop bible carrying case as defined in claim 4 wherein the bottom wall includes:

an interior wall member; and an exterior wall member, having an opening formed therein, aligned adjacent to and spaced from the interior wall member so that a cavity is formed therein and so that access to the cavity can be gained through the opening in the exterior wall.

6. A desktop bible carrying case as defined in claim 5 further including:

a first elongated coupling member formed along lower portions of the top wall; and a second elongated coupling member formed along upper portions of the front and side walls so that the first and second elongated coupling members can be lockingly engaged to secure the top wall to the front and side walls.

7. A desktop bible carrying case as defined in claim 6 further including an handle coupled to the front wall.

8. A desktop bible carrying case as defined in claim 7 wherein the handle includes:

a first support member;

a second support member spaced from and aligned with the first support member; and a grip member coupled between the first and second support members.

9. A desktop bible carrying case including:

a first enclosure having a cavity formed therein;

a second enclosure having a cavity formed therein aligned with and pivotably coupled to the first enclosure;

a first support ridge coupled in the first cavity to inside portions of the first enclosure;

a second support ridge coupled in the second cavity to inside portions of the second enclosure;

a first planar shaped desktop member aligned in the first enclosure;

a second planar shaped desktop member aligned in the second enclosure and pivotably coupled to the first planar shaped desktop member;

a first elevating member pivotably coupled to an uppermost end of the first desktop member; and a second elevating member pivotably coupled to an uppermost end of the second desktop member.

10. A desktop bible carrying case as defined in claim 9 wherein the first and second enclosures include:

an upstanding front wall;

an upstanding back wall aligned with and spaced from the front wall;

a first side wall coupled to extend between one end of the front and back walls;

a second side wall coupled to extend between another end of the front and back walls;

a flexibly extending skirt-like member formed on uppermost portions of the second side wall and back walls; and a bottom wall aligned in coupling engagement with bottom portions of the front and back and first and second side walls, so that the support cavity is formed between the walls.

11. A desktop bible carrying case as defined in claim 10 wherein:

the support ridge of the first and second enclosures is coupled in the cavity to inside portions of the front, back and side walls;

the planar shaped desktop members are pivotably coupled to each other at innermost portions thereof and to the flexibly extending skirt-like member at uppermost portions of the flexibly extending skirt-like member; and the elevating members are pivotably coupled to an uppermost end of the desktop members adjacent to the second side walls.

12. A desktop bible carrying case as defined in claim 11 wherein the first and second enclosures each further includes a coupling means for pivotably coupling the top wall to the upper end portions of the back wall.

13. A desktop bible carrying case as defined in claim 12 wherein the coupling means includes an elongated spiral coupling member aligned to engage inside and outside portions of the back wall, so that the enclosures can be pivotable from a closed position to an open position.

14. A desktop bible carrying case as defined in claim 13 wherein the back wall of the first and second enclosures each include:

an interior wall member;

an exterior wall member having an opening formed therein aligned adjacent to and spaced from the interior wall members so that a cavity is formed therebetween and so that access to the cavity can be gained through the opening in the exterior wall.

15. A desktop bible carrying case as defined in claim 14 wherein the back wall further includes a pair of pocket members with each pocket member including;

an interior wall member; and an exterior wall member, having an opening formed therein, aligned adjacent to and spaced from the interior wall member so that a cavity is formed therebetween and so that access to the cavity can be gained through the opening in the exterior wall.

16. A desktop bible carrying case as defined in claim 15 wherein each pocket member includes a plurality of adjacently aligned elongated pocket members formed thereon.

17. A desktop bible carrying case as defined in claim 16 further including:

a first elongated coupling member formed along lower portions of the front and side walls of the first enclosure; and a second elongated coupling member formed along upper portions of front and side walls of the second enclosure so that the first and second elongated coupling members can be lockingly engaged to secure the first enclosure to the second enclosure.

18. A desktop bible carrying case as defined in claim 17 further including an handle coupled to the front wall of the first enclosure.

19. A desktop bible carrying case as defined in claim 18 wherein the handle includes:

a first support member;

a second support member spaced from and aligned with the first support member; and a grip member coupled between the first and second support members.

* * * * *